US005205780A

United States Patent [19]

Rasmussen

[11] Patent Number: 5,205,780

[45] Date of Patent: Apr. 27, 1993

[54] DISC-TYPE COIN SORTER WITH ECCENTRIC FEED

[75] Inventor: James M. Rasmussen, Chicago, Ill.

[73] Assignee: Cummins-Allison Corporation, Mt. Prospect, Ill.

[21] Appl. No.: 694,952

[22] Filed: Apr. 29, 1991

[51] Int. Cl.[5] ..... G07D 3/00

[52] U.S. Cl. ..... 453/10; 453/57

[58] Field of Search ..... 453/6, 10, 32, 57

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/32 X |
| 4,607,649 | 8/1986 | Taiple et al. . | |
| 4,681,128 | 7/1987 | Ristvedt et al. . | |
| 4,731,043 | 3/1988 | Ristvedt | 453/6 |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. . | |
| 5,009,627 | 4/1991 | Rasmussen | 453/10 |
| 5,011,455 | 4/1991 | Rasmussen | 453/10 |
| 5,026,320 | 6/1991 | Rasmussen . | |

FOREIGN PATENT DOCUMENTS

| | | | |
|---|---|---|---|
| 2012863 | 10/1971 | Fed. Rep. of Germany | 453/10 |

*Primary Examiner*—F. J. Bartuska

*Attorney, Agent, or Firm*—Arnold, White & Durkee

[57] ABSTRACT

A coin sorter having a rotatable disc having a resilient top surface, a drive motor for rotating the disc, and a stationary sorting head having a lower surface parallel to the upper surface of the rotatable disc and spaced slightly therefrom. The sorting head has an opening in the central region thereof for feeding coins between the opposed surfaces of the disc and sorting head, and the feed opening has a center that is offset from the center of rotation of the disc so that coins deposited on the disc at the side of the opening spaced farther away from the center of the disc are carried under the sorting head by rotation of the disc.

7 Claims, 3 Drawing Sheets

DISC-TYPE COIN SORTER WITH ECCENTRIC FEED

BACKGROUND OF THE INVENTION

1. Field Of The Invention

The present invention relates generally to coin sorting devices and, more particularly, to coin sorters of the type which use a resilient rotating disc and a stationary sorting head for sorting coins of mixed denominations.

2. Description Of The Related Art

One of the advantages of disc-type coin sorters is their high coin-throughput rate. However, there are still certain constrains that tend to limit such sorters to throughput rates below their potential rates. One of these constraints is the rate at which coins can be fed into the narrow space between the rotating disc and the stationary head.

SUMMARY OF THE INVENTION

It is a primary object of the present invention to provide an improved disc-type coin sorter which has an improved coin-feed arrangement to increase the rate at which coins are processed by the sorter.

It is another important object of this invention to provide an improved disc-type coin sorter which promotes more effective feeding of coins downwardly from the feed hopper onto the rotating disc, and then into the narrow space between the rotating disc and the stationary sorting head.

Still another object is to provide an improved disc-type coin sorter which allows additional area for coin-queuing channels directly inboard of the exit channels for the largest diameter coins being sorted.

A further object of this invention is to provide an improved disc-type coin sorter which reduces the effects of coin blockage in retarding the entry of coins into the space between the rotating disc and the stationary sorting head. In this connection, one specific object of the invention is to provide such a sorter which avoids the accumulation of coins standing on edge in the feed opening of the sorting head.

Yet another object of this invention is to provide an improved disc-type coin sorter which increases the forces acting on the coins to urge them into the space between the rotating disc and the stationary sorting head.

A still further object of this invention is to provide an improved disc-type coin sorter which allows coin-queuing features, e.g., for stripping apart stacked or shingled coins and for lining up staggered coins, to be located near the point where the coins begin to be moved radially outwardly along the lower surface of the sorting head.

Other objects and advantages of the invention will be apparent from the following detailed description and the accompanying drawings.

In accordance with the present invention, the foregoing objectives are realized by providing a coin sorter comprising a rotatable disc having a resilient top surface, means for rotating the disc, and a stationary sorting head having a lower surface parallel to the upper surface of the rotatable disc and spaced slightly therefrom, the sorting head having an opening in the central region thereof for feeding coins between the opposed surfaces of the disc and sorting head, the feed opening having a center that is offset from the center of rotation of the disc so that coins deposited on the disc at the side of the opening spaced farther away from the center of the disc are carried under the sorting head by rotation of the disc.

DESCRIPTION OF THE PREFERRED EMBODIMENTS

Figure 1:
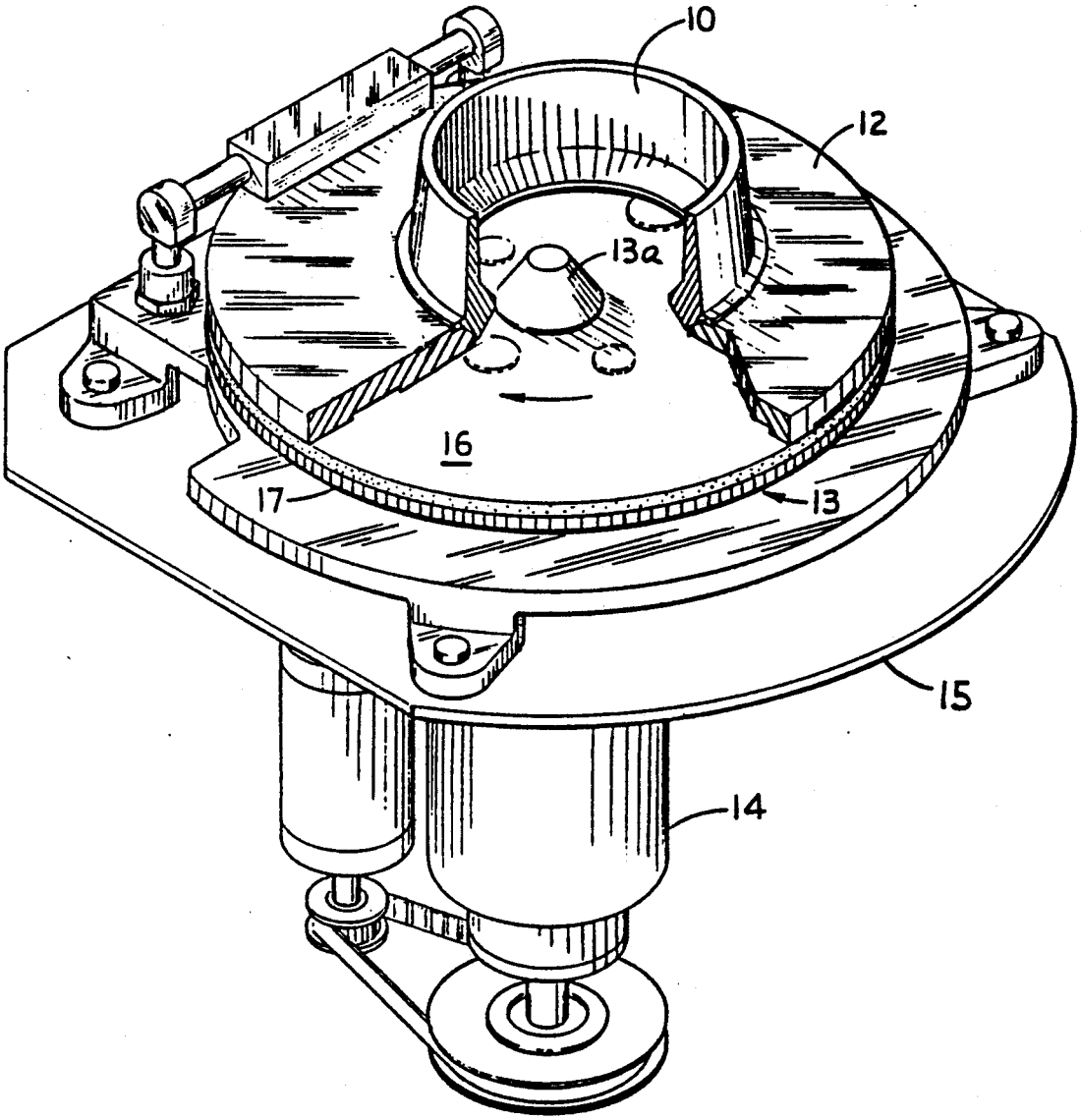
FIG. 1 is perspective view of a coin sorter embodying the present invention, with portions thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a feed opening 11 in an annular sorting head or guide plate 12. As the coins pass through the feed opening 11, they are deposited on the top surface of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the sorting head 12 because the underside of the inner periphery of this plate is spaced above the pad 16 by a distance, e.g., 0.010 inch, which is slightly less than the thickness of the thinnest coin. As further described below, the coins are sorted into their respective denominations, and the coins for each denomination issue from a respective exit slot, such as the slots 20, 21, 22, 23, 24 and 25. The particular embodiment illustrated in FIG. 2 was specifically designed for handling six Australian coins, i.e., all the Australian coins except the one-cent and two-cent coins.

In general, the coins for any given currency are sorted by the variation in diameter for the various denominations. Prior to sorting, the coins are manipulated between the sorting head and the rotating disc to queue the coins into a single-file, single-layer stream of coins. The outer edges of all the coins in this stream of coins are normally aligned at a common radius so that the inner edges of the coins can be engaged to discriminate among coins of different diameters, directing the coins to the exit slots for the respective denominations.

Figure 2:
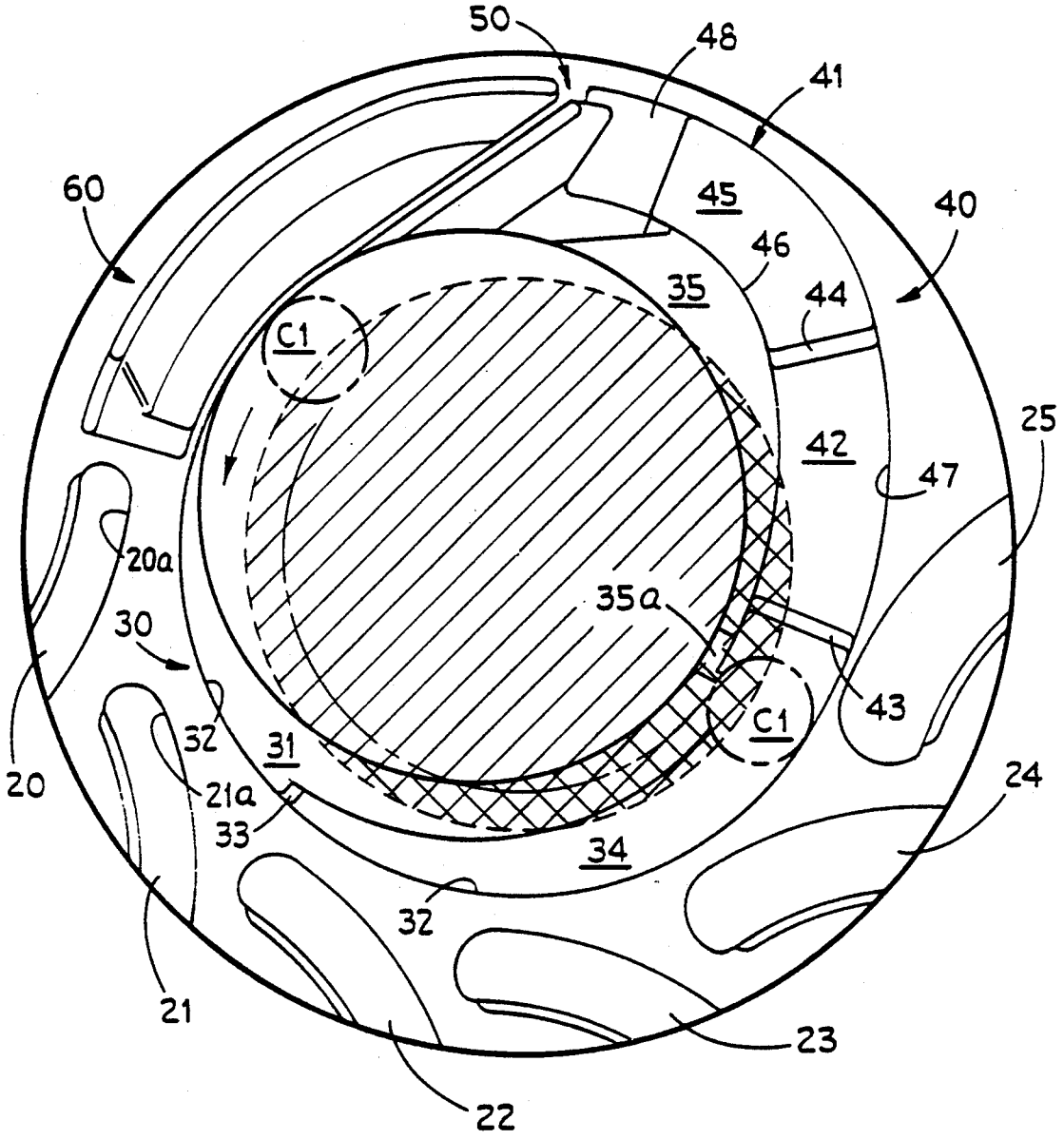
FIG. 2 is an enlarged bottom plan view of the sorting head or guide plate in the coin sorter of FIG. 1.

Turning now to FIG. 2, there is shown a bottom view of the preferred sorting head 12 including various channels and other means especially designed for high-speed sorting with positive control of the coins. It should be kept in mind that the circulation o the coins, which is clockwise in FIG. 1, appears counterclockwise in FIG. 2 because FIG. 2 is a bottom view. The various means operating upon the coins include an entry region 30, a queuing region 40 which includes a spiral channel 41 and means for stripping shingled or stacked coins, a recirculating region 50 for recycling coins which are not properly queued, a gaging channel 60, and the exit channels 20–25 for the six different coin denominations.

Considering first the entry region 30, the coins deposited on the rotating disc 13 directly beneath the feed opening 11 are carried under a semi-annular recess 31 formed along the inner periphery of the sorting head 12. Coins can move radially into the recess 31, which is spaced above the top surface of the pad 16 by a distance which is about the same as the thickness of the thickest denomination of coin.

In accordance with the present invention, the feeding of coins into the entry region 30 is enhanced by offsetting the center of the feed opening 11 from the center of rotation of the disc 13. This offset is illustrated in FIG. 2 by the shaded area, which depicts where the feed opening 11 would be located if it were concentric with the disc 13. The cross-hatched shaded area is the additional area made available between the eccentric feed opening and the exit channels for the largest-diameter coins.

By offsetting the center of the coin-feed opening from the center of rotation of the disc, in a direction away from the entry region where the coins first enter into the area under the sorting head, the invention enables coins to be fed into the area under the sorting head at a rate significantly above the rates achievable in sorters in which the coin-feed opening is concentric with the disc. With this arrangement, many of the coins drop onto the rotating disc in an area which is already at a greater radius from the center of rotation of the disc than is possible with a concentric feed opening. Consequently, such coins begin their transport by the rotating disc at a higher linear velocity than would otherwise be possible, and by the time they first enter into the area under the sorting head, these coins are already moving at a linear velocity which carries them quickly into the outwardly spiralling channel 41 leading to the sorting area. Because of this greater initial linear velocity of the coins, the thicker coins such as the 50-cent coins in the Australian coinage, pass beneath the sorting head much more easily and rapidly, thereby further increasing the coin-throughput rate. Also, coins can be carried into the entry region 30 by the circumferential movement of the coin on the surface of the rotating disc, as illustrated by the path o the coin C1 in FIG. 2.

This eccentric feed arrangement permits the coin throughput rate to be significantly increased for a sorter of any given size. In the alternative, the size of the coin sorter can be significantly reduced for any given coin-throughput rate. Of course, various combinations of these two improvements are also possible.

A further advantage of the eccentric feed opening is that it makes available additional area in the queuing region of the sorting head between the periphery of the feed opening and the exit channels for the larger-diameter coins. This additional area is illustrated by the cross-hatched crescent in FIG. 2, which shows that a spiral channel wide enough to accommodate a large-diameter coin C1 can be provided directly adjacent the exit channel 25 for the largest-diameter coin. To achieve this advantage, it is preferred that the feed opening be offset in a direction away from the inner edges of the wider exit channels, such as the exit channels 24 and 25 in FIG. 2.

Figure 4:
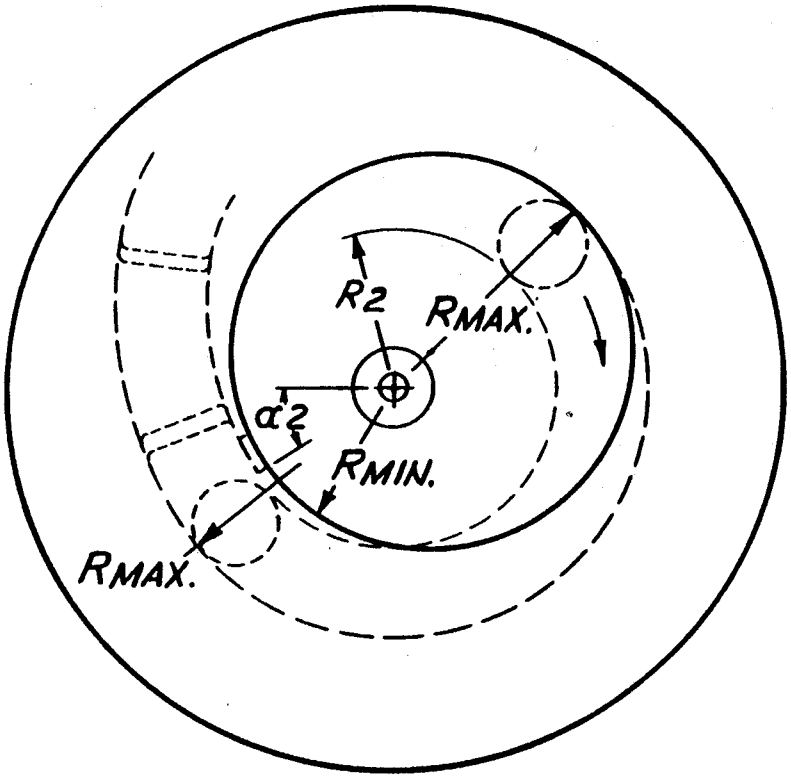
FIG. 4 is a diagrammatic illustration of a portion of a sorting head having a feed opening that is eccentric with respect to the rotating disc, with certain dimensions and coins superimposed thereon.
Figure 3:
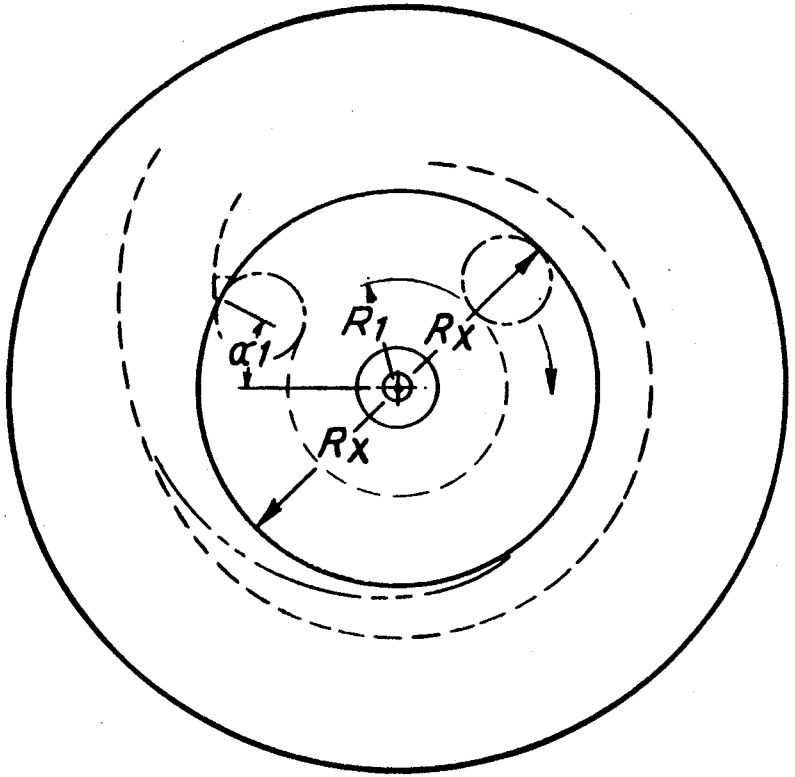
FIG. 3 is a diagrammatic illustration of a portion of a sorting head having a feed opening that is concentric with the rotating disc, with certain dimensions and coins superimposed thereon.

The additional area provided for the queuing portion of the sorting head allows the length of the outward spiral channel to be extended, as illustrated in FIGS. 3 and 4. These figures are diagrammatic top plan views of two sorting heads, one with a concentric feed opening (FIG. 3) and the other with an eccentric feed opening (FIG. 4). Portions of the contoured surfaces on the undersides of the sorting heads are illustrated in broken lines, and the coins are illustrated as moving in a clockwise direction. In FIG. 3, the inner edge of the spiral channel begins at an angle $\alpha_1$ from a horizontal reference line. In FIG. 4, with the additional area provided for the spiral channel by the offsetting of the feed opening, the inner edge of the spiral channel begins at an angle $\alpha_2$ in the opposite direction from the horizontal reference line. Thus, the spiral channel has been extended by a distance equal to the sum of the angles $\alpha_1$ and $\alpha_2$.

In general, it is preferred to offset the center of the feed opening from the center of the rotating disc by an amount such that the maximum radial distance from the center of the disc to the periphery of the feed opening is equal to the radial distance from the center of the disc to the outer wall of the spiral channel adjacent the beginning of the inner wall of the spiral channel. It is preferred that the inlet end of the spiral channel be located at least 90° away, in the direction of coin travel, from the point of maximum radial spacing between the inner periphery of the sorting head 12 and the center of rotation of the disc 13. As illustrated in FIG. 4, this geometric between the offset feed opening and the entry to the spiral channel allows a coin which is against the periphery of the feed opening at its maximum radial distance from the center of the disc to be rotated directly into the spiral channel by the rotational movement of the disc. Indeed, such a coin will be fed into the entry of the spiral channel even if the coin is pressed into the resilient surface of the rotating disc as soon as it passes beneath the inner edge of the sorting head.

A further advantage of the eccentric feed opening is that it increases the churning of coins as they are fed into the feed opening through the hopper 10, thereby further increasing the rate at which coins are fed from the feed opening into the space between the sorting head and the rotating disc. The reasons for this enhanced churning action is apparent from a comparison of FIGS. 3 and 4. In FIG. 3, the radial distance between the center of rotation of the disc and the periphery of the feed opening is a constant value $R_x$, and the inner edge of a coin positioned against the wall of the feed opening follows a constant radius $R_1$. In FIG. 4, on the other hand, the radial distance between the center of rotation of the disc and the wall of the feed opening varies from a maximum $R_{max}$ to a minimum $R_{min}$. It will also be noted that the center of the rotating disc normally carries a small conical diverter 13*a* which directs coins toward the wall of the feed opening as the coins pass downwardly from the hopper 11 through the feed opening 11. With the eccentric feed opening of FIG. 4, the radial dimension of the annular space traversed by the rotating coins between the conical diverter 13*a* and the wall of the feed opening 11 is constantly changing from a minimum dimension at $R_{min}$ to a maximum dimension at $R_{max}$. Consequently, as coins move from the region of maximum radial dimension to the region of minimum radial dimension, the coins are driven against each other, thereby providing enhanced churning action. One of the specific advantages of this churning is that coins which tend to stand on edge against the wall of the feed opening are knocked down so that they lie flat on the resilient surface of the rotating disc, which is the orientation required for coins to enter into the narrow gap between the sorting head and the rotating disc.

Outward movement of coins within the recess 31 is terminated when they engage the outer wall 32, through the coins continue to be moved circumferentially along the wall 32 by the rotational movement of the disc 13. The outer wall 32 of the recess 31 extends downwardly to the lowermost surface of the sorting head 12, which is preferably spaced from the top surface of the pad 16 by a distance, e.g., 0.010 inch, which is slightly less than the thickness of the thinnest coin.

As the disc 13 rotates, thick coins in the recess 31 that are next to the wall 32 engage a ramp 33 which presses the coins into the pad 16; thereafter their radial position is fixed by pressure between the pad 16 and a surface 34. Thick coins which fail to initially engage the ramp 33, engage a wall along the inner edge of the ramp 33 and the surface 34 and are recirculated back into the feed opening of the sorting head. This prevents misaligned thick coins from hindering the flow of coins to the spiral channel 41.

A portion of the feed opening of the sorting head 12 which does not open directly into the recess 31 is occupied by a land 35 whose lower surface is at a slightly higher elevation than the lowermost surface of the sorting head. The upstream end of the land 35 forms a ramp **35*a* (FIG. 2). When a coin has only partially entered the recess 31, it engages the ramp 35*a* on the leading edge of the land 35. The ramp 35*a* presses the coin downwardly into the resilient pad 16**, which causes the coin to be recirculated.

Coins which clear the ramp **35*a* enter the spiral channel 41 which guides the coins to the gaging channel 60. Coins of all denominations exit the spiral channel 41 with a common edge (the outer edges of all coins) aligned at the same or approximately the same radial position so that the opposite (inner) edges of the coins can be used for sorting. A recycling channel 50 is provided at the outlet of the spiral channel 41**, for recycling coins which do not have their outer edges close to the outer walls of the respective channels.

The illustrative spiral channel 41 also strips apart stacked or shingled coins. Thus, region 42 within the spiral channel is at a lower elevation than the rest of the channel, e.g, surface 45. In general, the combined thickness of a pair of stacked or shingled coins is great enough to cause the lower coin in that pair to be pressed into the resilient pad 16 as the pair of coins traverses the region 42 and its entry and exit ramps 43 and 44, respectively. Consequently, that pair of coins will be rotated concentrically with the disc until the upper coin engages the inner wall 46, and the lower coin passes under the land 35. The latter coin will be recirculated back to the entry region of the sorting head and will later reenter the spiral channel.

It can occur that correctly aligned coins passing under the recycling channel 51 can be slightly shifted in their radial position. To correct this, coins which pass the recycling channel 51 enter the gaging channel 60 which allows the coins to be realigned against the radially outer wall 61. The channel 60 and wall 41 allow the coins in the sorting path an opportunity to realign their outer edges at the radial position required for correct sorting. To ensure that every coin engages the wall 61, the radius of the wall 61 from the center of the disc is gradually decreased along the length of the channel 60.

Beyond the gaging channel 50, the sorting head 12 forms the series of exit channels 20–25 spaced circumferentially around the outer periphery of the sorting head, with the innermost edges of successive channels located progressively farther away from the common radial location of the outer edges of all the coins for receiving and ejecting coins in order of increasing diameter. The width of each exit channel is preferably smaller than the diameter of the coin to be received and ejected by that particular recess, so that the surface of the sorting head adjacent the radially outer edge of each exit channel presses the outer portions of the coins received by that channel into the resilient pad 16, thereby tilting the inner edges of those coins upwardly into the channel. The exit channels extend outwardly to the periphery of the sorting head so that the inner edges of these channels guide the tilted coins outwardly and eventually eject those coins from between the sorting head 12 and the resilient pad 16.

The innermost edges of the exit channels 20–25 are positioned so that the inner edge of a coin of only one particular denomination can enter each channel; the coins of all other remaining denominations extend inwardly beyond the innermost edge of that particular channel so that the inner edges of those coins cannot enter the channel.

For example, the first exit channel 20 is intended to discharge only Australian 5-cent coins, and thus the innermost edge **20*a* of this channel is located at a radius that is spaced inwardly form the final radius of the gaging wall 61 by a distance that is only slightly greater than the diameter of a 5-cent coin. Consequently, only 5-cent coins can enter the channel 20. Because the outer edges of all denominations of coins are located at the same radial position when they leave the gaging channel 60, the inner edges of all denominations other than the 5-cent coin extend inwardly beyond the innermost edge of the exit channel 20**, thereby preventing these coins from entering that particular channel.

At exit channel 21, the inner edges of only the Australian 2-dollar coins are located close enough to the periphery of the sorting head 12 to enter the exit channel. The inner edges of all the larger coins extend inwardly beyond the innermost edge **21*a* of the channel 21 so that they remain gripped between the sorting head 12 and the resilient pad 16. Consequently, all the coins except the 2-dollar coins continue to be rotated past the exit channel 21**.

Similarly, only Australian 10-cent coins enter the exit channel 22, only Australian 1-dollar coins enter the channel 23, only Australian 20-cent coins enter the channel 24, and only Australian 50-cent coins enter the channel 25.

I claim:

1. A coin sorter comprising a rotatable disc having a resilient top surface, means for rotating said disc, a stationary sorting head having an opening in the central region thereof for feeding coins between the opposed surfaces of said disc and sorting head, said opening having a center that is offset from the center of rotation of said disc so that coins deposited on said disc at the side of the opening spaced farthest away from said center of said disc are carried under the sorting head by rotation of said disc, said sorting head having a contoured surface spaced slightly away from and generally parallel to said resilient surface of said rotatable disc, and including means for sorting and discharging said coins of different denominations at different exits around the periphery of said stationary sorting head, said sorting head forming a spiral channel for guiding coins radially outwardly along the lower surface of the sorting head as the coins are carried in a circumferential direction by the rotating disc, the inlet end of said spiral channel being located at least 90° away, in the direction of coin travel from the point of maximum radial spacing between the inner periphery of the sorting head and the center of rotation of the disc.

2. The coin sorter of claim 1 wherein the radial distance from the center of rotation of the disc to the outer edge of said spiral channel at the inlet end of said channel is at least as great as the maximum radial distance between the center of rotation of the disc and the inner periphery of the sorting head.

3. The coin sorter of claim 2 wherein the radial distance between the inner periphery of the sorting head and the center of rotation of the disc is progressively reduced from said point of maximum radial spacing to the inlet end of said spiral channel.

4. A coin sorter comprising:

a rotatable disc having a resilient top surface, means for rotating said disc, and a stationary sorting head having an opening in the central region thereof for feeding coins between the opposed surfaces of said disc and sorting head, said sorting head forming a spiral channel for guiding coins radially outwardly along the lower surface of the sorting head as the coins are carried in a circumferential direction by the rotating disc, and a portion of the periphery of said feed opening being spaced farther away from the center of said disc than the periphery of said opening directly adjacent the inlet end of the inner edge of said spiral channel, said sorting head having a contoured surface spaced slightly away from and generally parallel to said resilient surface of said rotatable disc, and including means for sorting and discharging said coins of different denominations at different exits around the periphery of said stationary sorting head, the inlet end of said spiral channel being located at least 90° away, in the direction of coin travel, from the point of maximum radial spacing between the inner periphery of the sorting head and the center of rotation of the disc.

5. The coin sorter of claim 4 wherein said opening is generally circular, and the center of said opening is offset from the center of rotation of said disc.

6. A coin sorter comprising:

a rotatable disc having a resilient top surface, means for rotating said disc, a stationary sorting head having an opening in the central region thereof for feeding coins between the opposed surfaces of said disc and sorting head, said sorting head having a contoured surface spaced slightly away from and generally parallel to said resilient surface of said rotatable disc, and including means for sorting and discharging said coins of different denominations at a plurality of exit channels formed in said sorting head for ejecting coins of different diameters at different locations along the outer periphery of said sorting head, and said sorting head forming a spiral channel for guiding coins radially outwardly along the lower surface of the sorting head as the coins are carried in a circumferential direction by the rotating disc.

the center of said opening being spaced farther from at least certain of said exit channels than the center of rotation of said disc, the inlet end of said spiral channel being located at least 90° away, in the direction of coin travel, from the point of maximum radial spacing between the inner periphery of the sorting head and the center of rotation of the disc.

7. The coin sorter of claim 6 wherein the inner edges of said exit channels are located at different radial distances from the center of rotation of said disc, and the center of said opening is spaced farther from the exit channel having the innermost inner edge, than the center of rotation of said disc.

* * * * *